US009055613B2

(12) United States Patent
Kutz

(10) Patent No.: US 9,055,613 B2
(45) Date of Patent: Jun. 9, 2015

(54) FORMABLE HELICAL WIRE HEATING COIL ASSEMBLY

(75) Inventor: Edward A. Kutz, Muskego, WI (US)

(73) Assignee: Nova Coil, Inc., Franklin, WI (US)

( * ) Notice: Subject to any disclaimer, the term of this patent is extended or adjusted under 35 U.S.C. 154(b) by 1010 days.

(21) Appl. No.: 13/167,187

(22) Filed: Jun. 23, 2011

(65) Prior Publication Data

US 2012/0325800 A1 Dec. 27, 2012

(51) Int. Cl.

| | |
|---|---|
| ***H05B 1/02*** | (2006.01) |
| ***H05B 3/06*** | (2006.01) |
| ***H05B 3/74*** | (2006.01) |

(52) U.S. Cl.

CPC ..... *H05B 3/06* (2013.01); *Y10T 29/49083* (2015.01); *H05B 3/748* (2013.01)

(58) Field of Classification Search

CPC ..... H05B 1/02; H05B 3/06; H05B 3/748; H05B 3/08

See application file for complete search history.

(56) References Cited

U.S. PATENT DOCUMENTS

| | | | | | |
|---|---|---|---|---|---|
| 4,458,141 | A * | 7/1984 | Howard et al. | ..... | 219/532 |
| 4,472,624 | A * | 9/1984 | Janning | ..... | 219/532 |
| 4,675,511 | A * | 6/1987 | Sherrill | ..... | 219/532 |
| 5,093,558 | A * | 3/1992 | Blystone et al. | ..... | 219/532 |
| 5,880,440 | A * | 3/1999 | Whitfield et al. | ..... | 219/536 |
| 5,954,983 | A | 9/1999 | Holmes | | |
| 6,192,829 | B1 * | 2/2001 | Karazim et al. | ..... | 118/723 AN |
| 6,285,013 | B1 | 9/2001 | Holmes | | |
| 6,376,814 | B2 | 4/2002 | Holmes | | |
| 2008/0173636 | A1 | 7/2008 | Kutz | | |

* cited by examiner

*Primary Examiner* — Mark Paschall

(74) *Attorney, Agent, or Firm* — Andrus Intellectual Property Law, LLP

(57) ABSTRACT

The supporting frame for a helical wire heating coil assembly is initially formed in a straight linear manner using an angular cross section shape and including integrally formed linear arrays of clips for mounting insulating stand-offs, attachment tabs for mounting the assembly and open notches that permit the frame to be subsequently formed into a circular or other arcuate shape.

13 Claims, 4 Drawing Sheets

FIG. 1
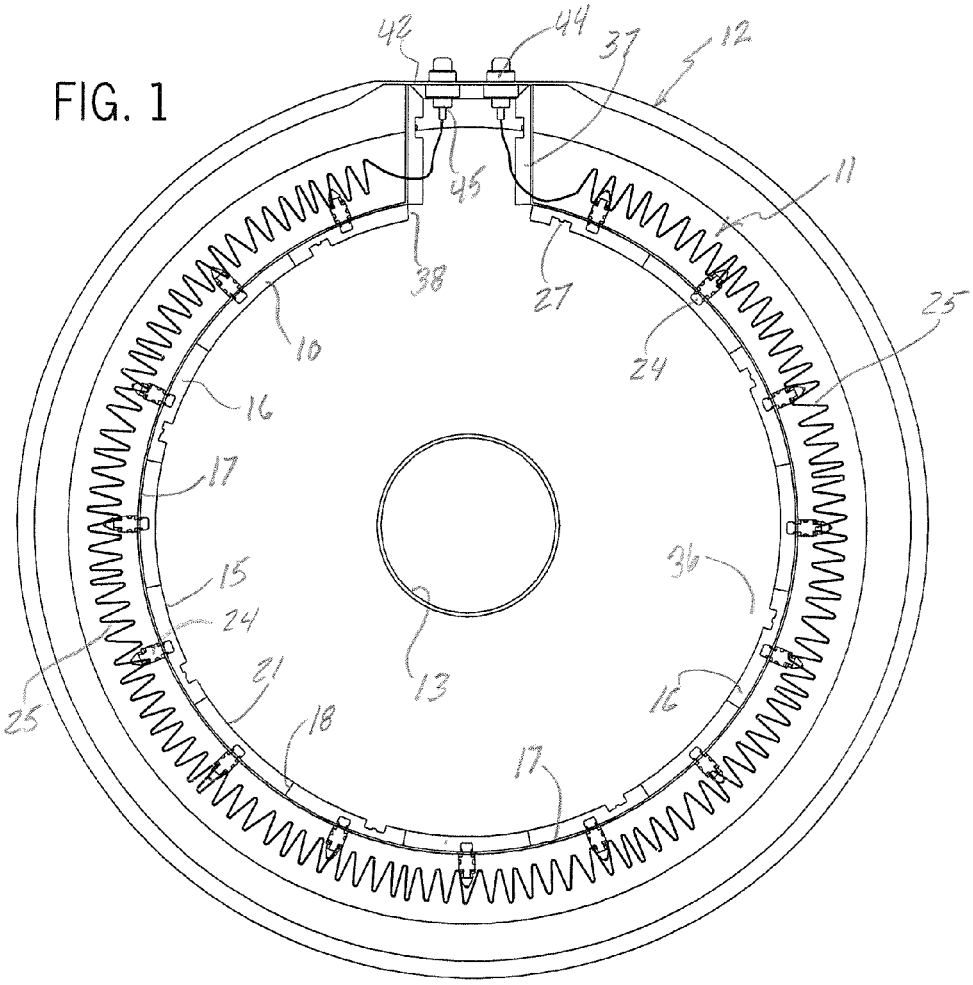
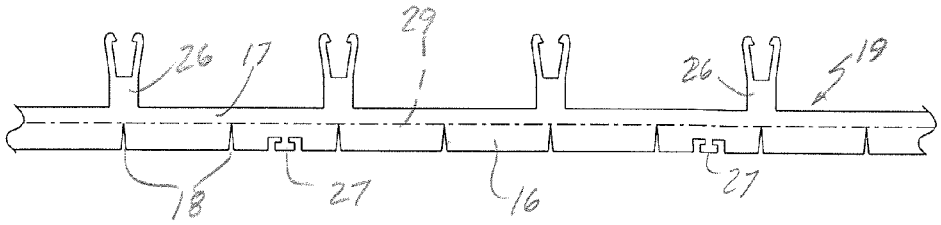
FIG. 2

FORMABLE HELICAL WIRE HEATING COIL ASSEMBLY

BACKGROUND AND SUMMARY

A resistance heating element utilizing a helical wire coil is made with a linear frame configuration and provided with relieved or notched areas permitting the frame to be reshaped from its linear configuration to a circular or other arcuate shape for mounting and use in a heating and/or drying appliance. More particularly, one embodiment of the description applies the reformed frame to a circular air duct housing component for a dryer.

In a basic embodiment of this disclosure, a formable helical wire heating coil assembly is adapted for attachment to a generally circular housing component, the assembly comprising an elongate sheet metal frame that has an angular cross sectional shape including a first leg and a second leg, the frame having spaced along its length and formed integrally therewith a linear array of open notches in the first leg, the notches having spaced edges that extend from the second leg to the free edge of the first leg. The frame is formable from its linear configuration in the plane of the first leg to at least partially close the notches and permitting the frame to assume a circular shape. In another embodiment, the frame includes an integrally formed linear array of clips for mounting insulating stand-offs in a spaced arrangement along the length of the frame. In a further embodiment, the frame includes an integrally formed linear array of attachment tabs spaced along the length of the frame for attaching the frame to the housing component.

In a method related to making the apparatus described above, a helical wire coil assembly adapted for attachment to a generally circular housing component is made by the method comprising the steps of: (1) for wing a straight elongate sheet metal frame having an angular cross sectional shape including a first leg and a second leg; (2) providing the frame along its length with an integrally formed linear array of open notches in the first leg which notches have spaced edges that extend from the second leg to the free edge of the first leg; and, (3) forming the frame in the plane of the first leg to at least partially close the notches and permit the frame to assume an arcuate shape. The method may also include the step of providing the frame along its length with a linear array of attachment tabs for connection to the housing component. The method may also include the step of providing the frame along its length with an integrally formed linear array of clips for attachment of insulting stand-offs.

In another embodiment of this disclosure, a formable helical wire heating coil assembly is adapted to be attached to a generally circular housing component with the assembly comprising an elongate sheet metal frame that has an angular cross sectional shape including a first leg and a second leg, the frame having spaced along its length and formed integrally therewith a linear array of open notches in the horizontal leg, the notches having spaced edges that extend from the second leg to the free edge of the first leg, whereby the frame is formable in the plane of the first leg to at least partially close the notches and cause the frame to assume a circular shape. Preferably, the notches are formed in a V-shape with the notch edges divergent toward the free edge of the first leg. The notches are preferably formed such that the notch edges abut in the smallest diameter form of the frame.

In a further embodiment of this disclosure, the circular array of attachment slots is formed in the planar face of the housing component and the array of attachment tabs is provided with a spacing that corresponds to the spacing of the attachment slots. When the frame is formed to a circular shape, the tabs are received in the slots. Preferably, the tabs are locked in the slots and, more preferably, the tabs are locked by twisting.

In a further embodiment, the clips extend from the free edge of the second leg and in the plane thereof. Preferably, the clips have bifurcated free ends that are defined by generally parallel clip legs, and the stand-offs have a grooved body to receive the clip legs. A helical wire heating coil is attached to and supported by the stand-offs.

In another embodiment of this disclosure, a method of making a helical wire coil assembly is adapted for attachment to a generally circular housing component and includes the steps of forming a straight elongate sheet metal frame having an angular cross sectional shape that includes a first leg and a second leg; providing the frame along its length with integrally formed linear arrays of: clips for insulating stand-offs; attachment tabs for the housing component; and, open notches in the first leg having spaced edges extending from the second leg to the free edge of the first leg and forming the frame in the plane of the first leg to at least partially close the notches and to assume an arcuate shape. Preferably, the method includes the steps of forming the notches in a V-shape with side edges that diverge toward the free edge of the first leg, and forming the frame in the plane of the first leg to close the notches and to assume the arcuate shape. The arcuate shape is preferably circular. In a further embodiment, the step of forming the frame includes causing the edges of the notches to abut.

In a further embodiment of the method, steps are provided for: forming a circular array of attachment slots in a planar face of the housing component; providing the array of attachment tabs with a spacing that corresponds to the spacing of the attachment slots; and, forming the frame to a circular shape in which the tabs are received in the slots. The step preferably includes locking the tabs in the slots. More preferably, the locking step comprises twisting the tabs.

The modified embodiment of the disclosed method may include the steps of: forming the clips to extend from the free edge of the second leg and in the plane thereof; providing the clips with a bifurcated free end defined by generally parallel clip legs; and, providing the insulating stand-offs with a grooved body positioned to receive the clip legs. This method preferably includes the step of attaching a helical wire heating coil to the stand-offs. The method may also include the step of squeezing the clip legs toward each other to lock the stand-off in the clip.

In a further embodiment, the method includes the steps of: forming the notches in the straight frame to provide the notches with generally parallel spaced edges; and, forming the frame to the arcuate shape and causing the notches to close such that the outermost ends of the notch edges converge at the free edge of the first leg. The arcuate shape to which the frame is formed is preferably circular. Further, the step of forming the frame preferably includes causing the ends of the notch edges at the free edge of the frame to abut.

In a presently preferred method of this application for making a helical wire coil assembly adapted for attachment to a generally circular assembly housing component, the method includes the steps of: forming an elongate linear sheet metal frame having an angular cross-sectional shape including a first leg and a second leg; providing the frame along its length with integrally formed linear arrays of clips for insulating stand-offs and forming the clips to extend from the free edge of the second leg and in the plane thereof; attachment tabs in the first leg for the housing component and forming the tabs to extend generally perpendicular to the first leg and generally parallel to the clips; and, open notches in the first leg having a V-shape defined by spaced edges extending and diverging from the second leg to the free edge of the first leg; and, forming the frame in the plane of the first leg to close the notches and provide the assembly with a generally circular shape.

This disclosure also includes a method of packaging for shipment and use a helical wire heating coil assembly that, in use, is generally circular, the method comprising the steps of: forming a straight elongate sheet metal frame having an angular cross sectional shape that defines a first leg and a second leg; forming the first leg of the frame along its length with an integral linear array of open notches that extend from the second leg to the free edge of the first leg; providing a packaging and shipping container having a plurality of adjacent parallel enclosures sized to receive the straight frame; and, upon removal from the container, forming the frame in the plane of the first leg to at least partially close the notches to provide the circular shape. The method may also include the step of forming along the length of the frame integral linear arrays of clips for insulating stand-offs and attachment tabs for the housing component. The method also includes the step of attaching a helical wire heating coil to the stand-offs.

BRIEF DESCRIPTION OF THE DRAWINGS

FIG. 1 is an elevation view of the frame of the subject application showing the frame formed to its circular shape and mounted in a circular housing component.

FIG. 2 is a plan view of a flat preform for the straight frame component from which the circular frame in FIG. 1 is formed.

DETAILED DESCRIPTION

Figure 6A:
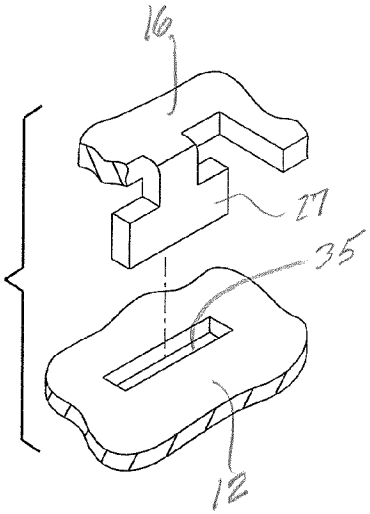
FIGS. 6A and 6B are detailed views showing one of the array of attachments of the frame to the housing component.
Figure 3:
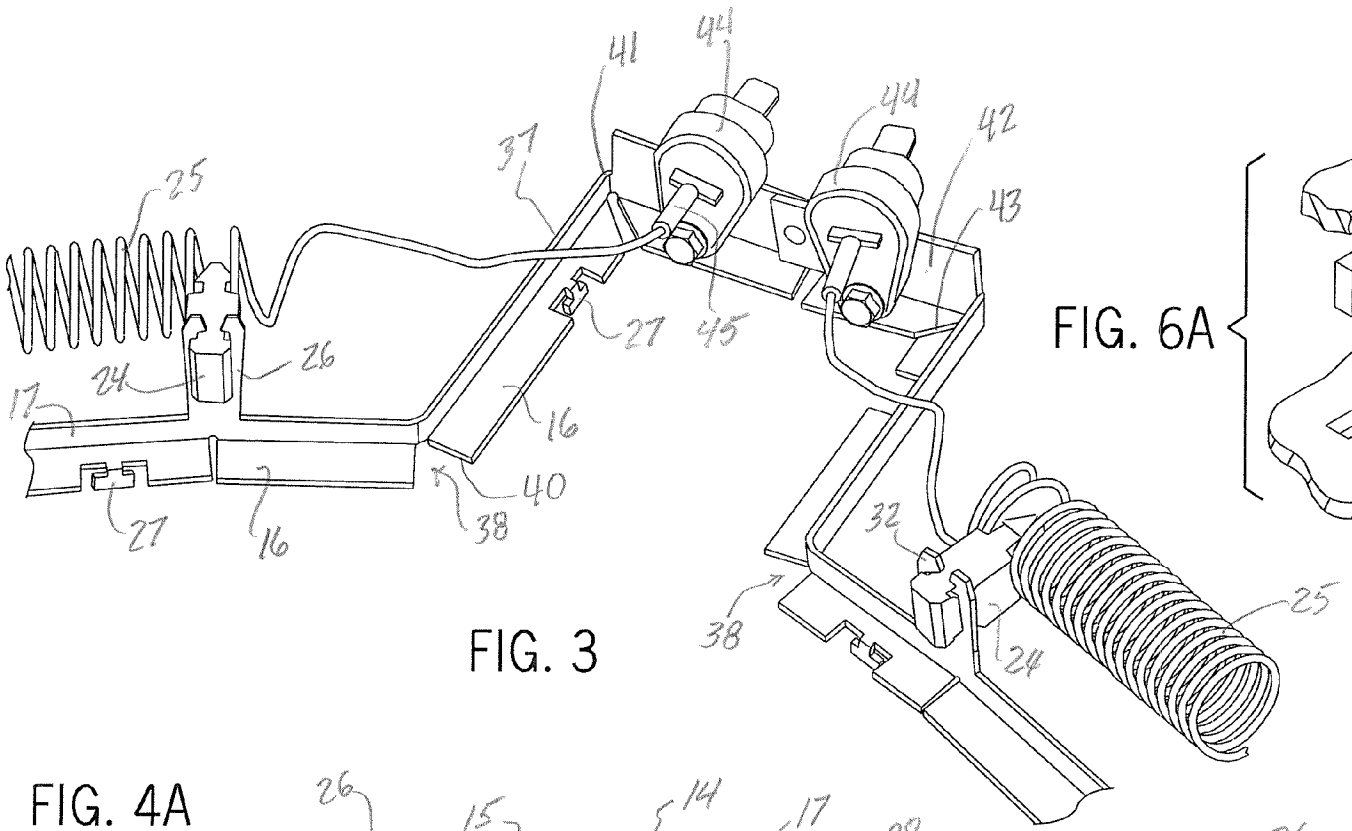
FIG. 3 is an enlarged isometric view of the terminal portion of the frame assembly of FIG. 1 showing attachment of other components of the assembly.

FIG. 1 shows a sheet metal frame 10 formed into a circular shape to support a circular helical wire heating coil in an assembly 11 particularly adapted for use in a clothes dryer. The heating coil assembly 11 is mounted on a generally circular housing component 12 that forms half of a heated air duct that heats air entering the duct from a center opening 13 and exiting after heating into a rotating dryer drum (not shown).

The heating coil assembly frame 10 is initially formed, preferably from aluminized steel sheet, in the form of a long linear frame 14 in a progressive die stamping process or other suitable manufacturing technique. Referring also to FIGS. 2-6, the frame 14 has a continuous narrow body 15 that has an angular cross-sectional shape that includes a first leg 16 and a second leg 17. The first and second legs are preferably perpendicularly oriented. In FIG. 2, there is shown a flat preform 19 that is subsequently bent on bend line 29 to form the angular cross sectional shape for the linear frame 14.

The first leg 16 of the frame 14 is provided along its full length with a linear array of V-shaped notches 18 that are defined by spaced edges 20 that extend and diverge from the second leg 17 to the outer free-edge 21 of the first leg. In other words, inner ends of the edges 20 of the V-shaped notches 18 meet at the base of the second leg 17, but are fully open at their outer ends where they meet the free edge 21 of the first leg 16.

When the linear frame 14 is subsequently formed into its final circular frame shape 10 by bending the frame in the plane of the first leg 16, the V-shaped notches 18 will close permitting formation of the circular frame 10. The frame 14 may be dimensioned such that, when frame 10 of the desired diameter is reached, the V-shaped notches 18 will be closed and the spaced edges 20 of the notches abut. However, larger diameter frames 10 may be produced without fully closing the V-shaped notches.

Figure 4A:
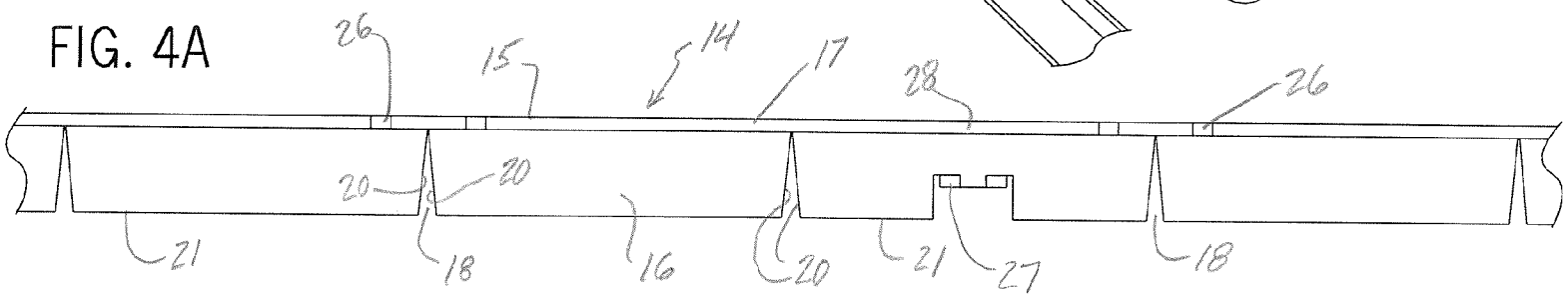
FIG. 4A is a top plan view of a detail of the frame shown in FIG. 2.
Figures 4B, 4C, 5, 6B:
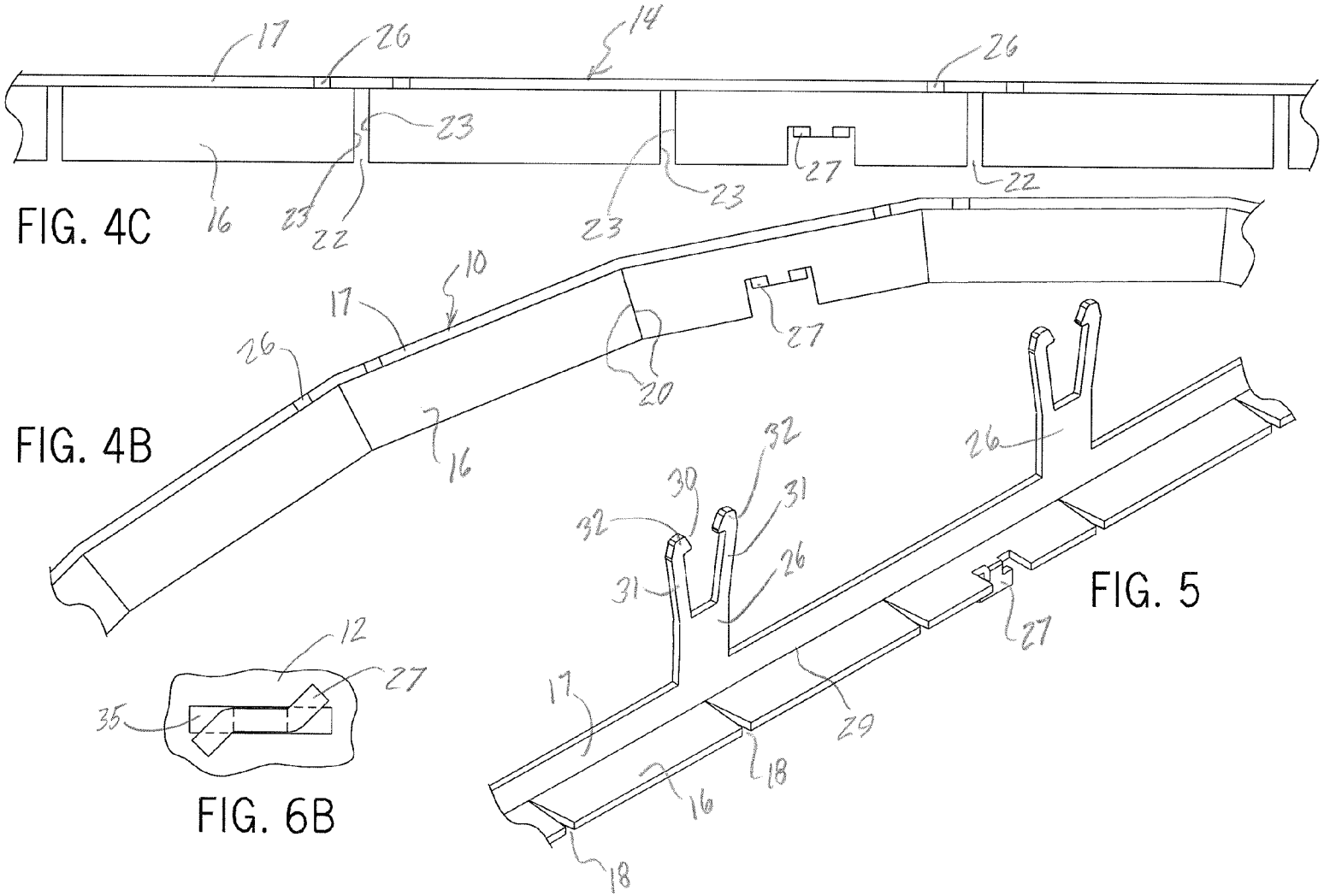
FIG. 4B is a view of the frame detail shown in FIG. 4A after it has been formed to an arcuate shape.
FIG. 4C is a view similar to FIG. 4A, but showing a variation in the formation notches.
FIG. 5 is an enlarged isometric detail showing details of the frame component of FIG. 4A.

Referring particularly to FIG. 4C, modified notches 22 of a generally rectangular nature may be used in lieu of the V-shaped notches 18. In this case, the modified notches 22 still extend from the second leg 17 to the free edge 21 of the first leg 16, but the spaced edges 23 of the modified notches 22 are parallel in the initial straight metal frame 14. However, upon subsequent forming of the straight frame piece 14 to a circular or other arcuate shape, modified notches 22 will close in generally the same manner as the V-shaped notches 18, but the fully closed circular frame 10 will be controlled by abutment of the ends of the spaced edges 23 at the free edge 21 of the first leg.

The initial straight sheet metal frame 14 includes other elements of the heating coil assembly 11 that permit attachment of the frame 10 in its formed circular shape to the housing component 12, and to support insulating stand-offs 24 that carry a heating coil 25 in a manner isolating and insulating the heating coil 25 form other metal frame elements. Thus, in addition to the array of spaced notches 18 or 22, the straight elongate sheet metal frame component 14 is also provided with integrally formed linear arrays of clips 26 for attachment of the stand-offs 24, and an integrally formed linear array of attachment tabs 27 for connection of the circular formed frame 10 to the dryer housing component 12.

The clips 26 extend from the free edge 28 of the second leg 17 and lie in the plane of the second leg. The clips 26 are formed with a bifurcated outer end 30 defined by generally parallel clip legs 31. In a manner that is generally known in the industry, each of the legs 31 terminates in tapered locking projection 32 permitting an insulating stand-off 24 with parallel opposite attachment grooves 33 to receive the clip legs 31 which are then squeezed together to lock the stand-off to the clip 26.

The outer end of the stand-off 24 has a special grooved construction defining a series of slots and abutments which are engaged by the heating coil 25 when the coil is pressed onto the insulating stand-off, as is also generally known in the art.

To attach the circular frame 10 of the heating coil assembly 11 to the circular housing component 12, the array of attachment tabs 27 is formed in the edge of the first leg 16 of the frame 14, in the embodiment shown, the attachment tabs 27 have a T-head shape and extend downwardly and generally perpendicular to the first leg 16 of the frame 14. The attachment tabs 27 after forming the circular frame 10, match up in circumferential spacing and circle diameter with an array of attachment slots 35 in a planar face 36 of the housing, component 12. Thus, when the straight base frame 14 is formed to the circular frame shape 10, as from FIG. 4A to FIG. 4B, the attachment tabs 27 match the positions of the attachment slots 35, permitting the tabs to enter the slots 35 and to be subsequently locked in position, as by twisting the tabs 27 or by using, other convenient modes of attachment.

In the embodiments shown in the drawings, clips 26 for the stand-offs 24 are oriented to position the heating coil 25 on the outside of the frame 10. However, in an alternate embodiment, the clips 26 may be repositioned by bending along their lines of attachment to the second leg 17 to correspondingly reposition the stand-offs 24 and heating coil 25.

In the initial formation of the straight frame 14, provision is made for the integral formation of end terminations 37 to provide support for electrical connection 45. In the final formation of the heating coil assembly 11, when the circular frame 10 is formed, the inner ends 40 of the end terminations 37 are back-bent resulting in widened notches 38. The outer ends 41 of the end terminations include terminal portions 42 that are formed by closing second widened notches 43 such that the terminal portions 42 extend generally perpendicularly to the end terminations 37 with their ends abutting one another. The terminal portions 42 also carry insulators 44 for the electrical connections 45 in a generally known manner.

To help stabilize and support the end terminations 37, the portions of the first legs 16 are provided with attachment tabs 27 that engage and are captured in attachment slots 35 in the surface of the housing component in the manner previously described.

Figure 7:
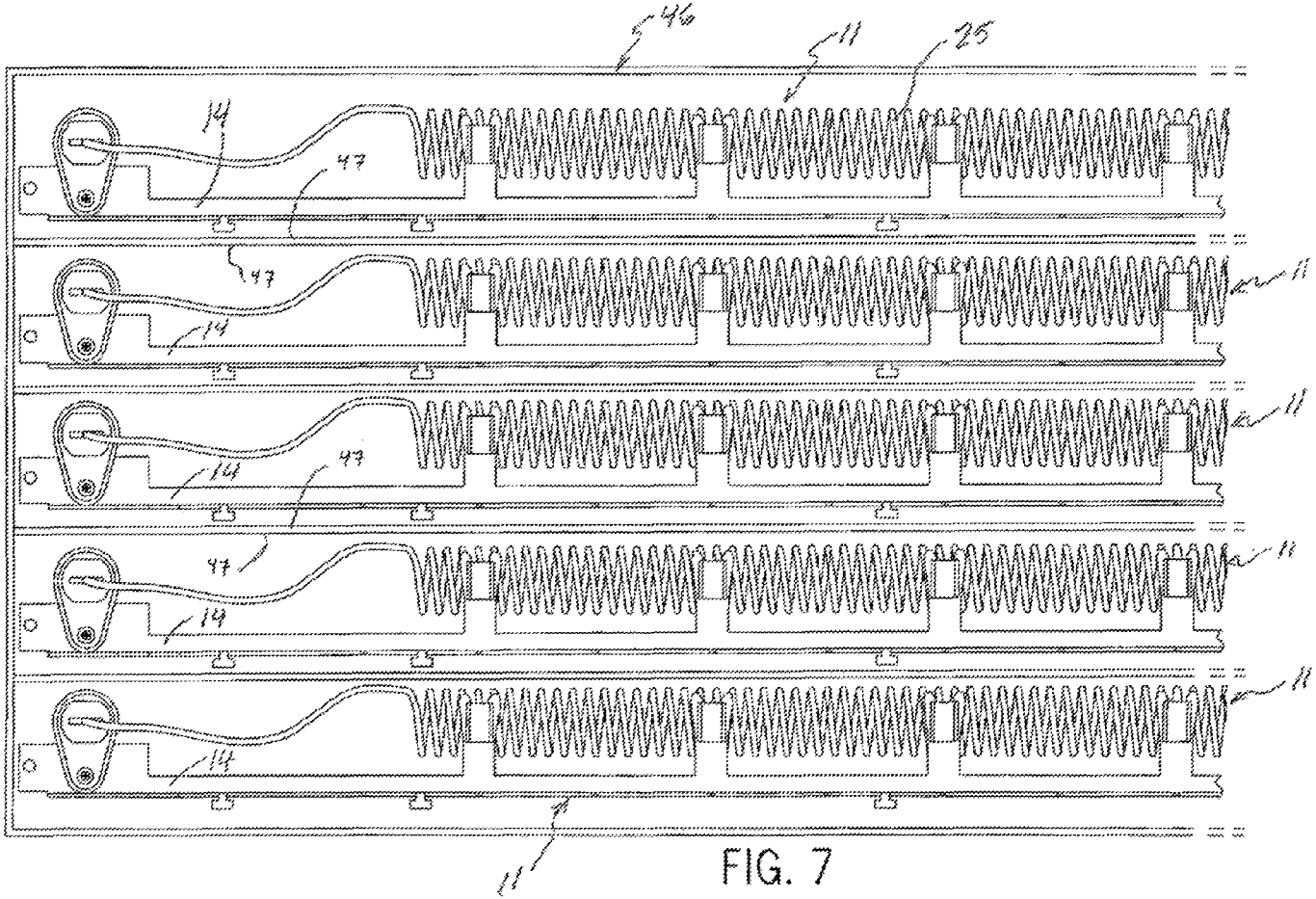
FIG. 7 is a top plan view of a shipping container showing completed heating coil assemblies packaged for shipment.

Another advantage provided by initially forming the straight frame 14 and preferably also attaching to it the various components for supporting the heating coil and attaching the heating coil assembly to the housing component 12, is that the straight unformed frame can be packaged for shipment in a space-saving manner. Referring particularly to FIG. 7, the completed heating coil assemblies 11, in the straight unformed embodiment of the frame 14 can be packaged in a packaging and shipping container 46 that has a plurality of adjacent parallel enclosures 47 requiring much less packaging volume than would be required for packaging and shipping the completed circular heating coil assembly 11. At the site of the dryer or other heating appliance manufacturer or assembler, completion of the circular formation 10 and attachment of that formation to the housing component 12 can be completed in an expeditious manner.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A formable helical wire heating coil assembly adapted for attachment to a generally circular housing component, the assembly comprising:

an elongate sheet metal frame having an angular cross sectional shape including a first leg having a free edge and a second leg that extends transversely to said first leg, the frame having spaced along its length and formed integrally therewith a linear array of open notches in the first leg, the notches having spaced edges extending from the second leg to the free edge of the first leg, whereby the frame is formed in the plane of the first leg to at least partially close the notches and to assume an arcuate shape wherein the free edge of the first leg faces radially inwardly.

2. The apparatus as set forth in claim 1 wherein the frame includes an integrally formed linear array of clips for insulating stand-offs spaced along the length of the frame.

3. The apparatus as set forth in claim 1 wherein the frame includes an integrally formed linear array of attachment tabs for the housing component spaced along the length of the frame.

4. A formable helical wire heating coil assembly adapted for attachment to a generally circular housing component, the assembly comprising:

an elongate sheet metal frame having an angular cross sectional shape including a first leg having a free edge and a second leg that extends transversely to said first leg, the frame having spaced along its length and formed integrally therewith a linear array of open notches in the first leg, the notches having spaced edges extending from the second leg to the free edge of the first leg, whereby the frame is formed in the plane of the first leg to at least partially close the notches and to assume a circular shape wherein the free edge of the first leg faces radially inwardly.

5. The apparatus as set forth in claim 4 wherein the notches are formed in a V-shape with the notch edges divergent toward the free edge of the first leg.

6. The apparatus as set forth in claim 5 wherein the notch edges abut in the smallest diameter form of the frame.

7. The apparatus as set forth in claim 4 wherein the clips extend from the free edge of the second leg and in the plane thereof.

8. The apparatus as set forth in claim 7 wherein the clips have a bifurcated free end defined by generally parallel clip legs, and the stand-offs have a grooved body to receive the dip leas.

9. The apparatus as set forth in claim 8 including a helical wire heating, coil attached to and supported by the stand-offs.

10. A formable helical wire heating coil assembly adapted for attachment to a generally circular housing component the assembly comprising:

an elongate sheet metal frame having an angular cross sectional shape including a first leg having a free edge and a second leg that extends transversely to said first leg, the frame having spaced along its length and formed integrally therewith a linear array of open notches in the first lea, the notches having spaced edges extending from the second leg to the free edge of the first leg, whereby the frame is formable in the plane of the first lea to at least partially close the notches and to assume a circular shape;

a circular array of attachment slots in a planar face of the housing component, and wherein the array of attachment tabs is provided with a spacing that corresponds to the spacing of the attachment slots, the frame is formed to a circular shape in which the tabs are received, in the slots.

11. The apparatus as set forth in claim 10 wherein the tabs are locked in the slots.

12. The apparatus as set forth in claim 11 wherein the tabs are twisted to lock in the slots.

13. A formable helical wire heating coil assembly adapted for attachment to a generally circular housing component, the assembly comprising:

an elongate sheet metal frame having an angular cross sectional shape including a first leg having a free edge and a second leg that extends transversely to said first leg, the frame having spaced along its length and formed integrally therewith a linear array of open notches in the first leg, the notches having spaced edges extending from the second leg to the free edge of the first leg, whereby the frame is formable in the plane of the first leg to at least partially close the notches and to assume an arcuate shape;

an arcuate array of attachment slots in a planar face of the housing component, and wherein the array of attachment tabs is provided with a spacing that corresponds to the spacing of the attachment slots, the frame is formed to an arcuate share in which the tabs are received in the slots.

* * * * *

UNITED STATES PATENT AND TRADEMARK OFFICE

CERTIFICATE OF CORRECTION

PATENT NO. : 9,055,613 B2
APPLICATION NO. : 13/167187
DATED : June 9, 2015
INVENTOR(S) : Edward A. Kutz It is certified that error appears in the above-identified patent and that said Letters Patent is hereby corrected as shown below:

In the Claims:

In claim 8, at column 6, line 31: “leas” should instead read --legs--.

In claim 9, at column 6, line 33: remove the “,” between “heating” and “coil”.

In claim 10, at column 6, line 35: add a --,-- between “componenent” and “the”.

In claim 10, at column 6, line 42: “lea” should instead read --leg--.

In claim 10, at column 6, line 44: “lea” should instead read --leg--.

In claim 10, at column 6, line 53: remove the “,” between “received” and “in”.

In claim 13, at column 7, line 9: “share” should instead read --shape--.

Signed and Sealed this
Thirteenth Day of October, 2015

Michelle K. Lee

Michelle K. Lee
*Director of the United States Patent and Trademark Office*